United States Patent [19]

Focke et al.

[11] Patent Number: 4,943,271

[45] Date of Patent: Jul. 24, 1990

[54] APPARATUS FOR THE PRODUCTION OF (CIGARETTE) PACKS

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 261,042

[22] Filed: Oct. 21, 1988

[30] Foreign Application Priority Data

Oct. 22, 1987 [DE] Fed. Rep. of Germany ..... 3735674

[51] Int. Cl.[5] ..... B31B 1/16; B31B 3/32

[52] U.S. Cl. ..... 493/24; 493/74; 493/164; 493/410; 225/4; 225/100

[58] Field of Search ..... 493/24, 62, 74, 164, 493/410, 411; 225/4, 100

[56] References Cited

U.S. PATENT DOCUMENTS

| | | | |
|---|---|---|---|
| 3,123,269 | 3/1964 | Morley et al. | 493/410 |
| 3,225,667 | 12/1965 | Fuchs | 493/164 |
| 3,871,763 | 3/1975 | Schrempp | 493/410 |
| 4,070,951 | 1/1978 | Bala | 493/24 |
| 4,072,549 | 2/1978 | Amberg et al. | 493/74 |
| 4,341,434 | 7/1982 | Pfister | 439/839 |
| 4,545,780 | 10/1985 | Martin | 493/74 |
| 4,680,023 | 7/1987 | Varano | 493/62 |
| 4,713,048 | 12/1987 | Reil et al. | 493/74 |
| 4,759,171 | 7/1988 | Bruveris et al. | 493/164 |

FOREIGN PATENT DOCUMENTS

| | | | |
|---|---|---|---|
| 1141610 | 12/1962 | Fed. Rep. of Germany | 493/411 |
| 2171676 | 9/1986 | United Kingdom . | |

*Primary Examiner*—William Terrell

*Attorney, Agent, or Firm*—Sughrue, Mion, Zinn, Macpeak & Seas

[57] ABSTRACT

In packaging machines with an integrated apparatus for the production, storage and conveyance of blanks, the arrangement of the apparatus within the packaging machine is important. It is necessary to ensure that free unimpeded access to the units is possible. On the other hand, the actual operation of the packaging machine should not be impaired. For this purpose, a web of material (16) for the production of the blanks (13) and in the form of a wound reel (17), a conveying track (18) for the web of material (16), a severing station (19) for forming the blanks (13) and a blank track (26) for feeding the blanks (13) to a folding turret (10) are arranged on the rear side (25) of the packaging machine. The conveying track (18) for the web of material (16) extends parallel to the longitudinal mid-plane of the packaging machine. The blank track (26) follows this transversely.

9 Claims, 5 Drawing Sheets

APPARATUS FOR THE PRODUCTION OF (CIGARETTE) PACKS

DESCRIPTION

Figure 1:
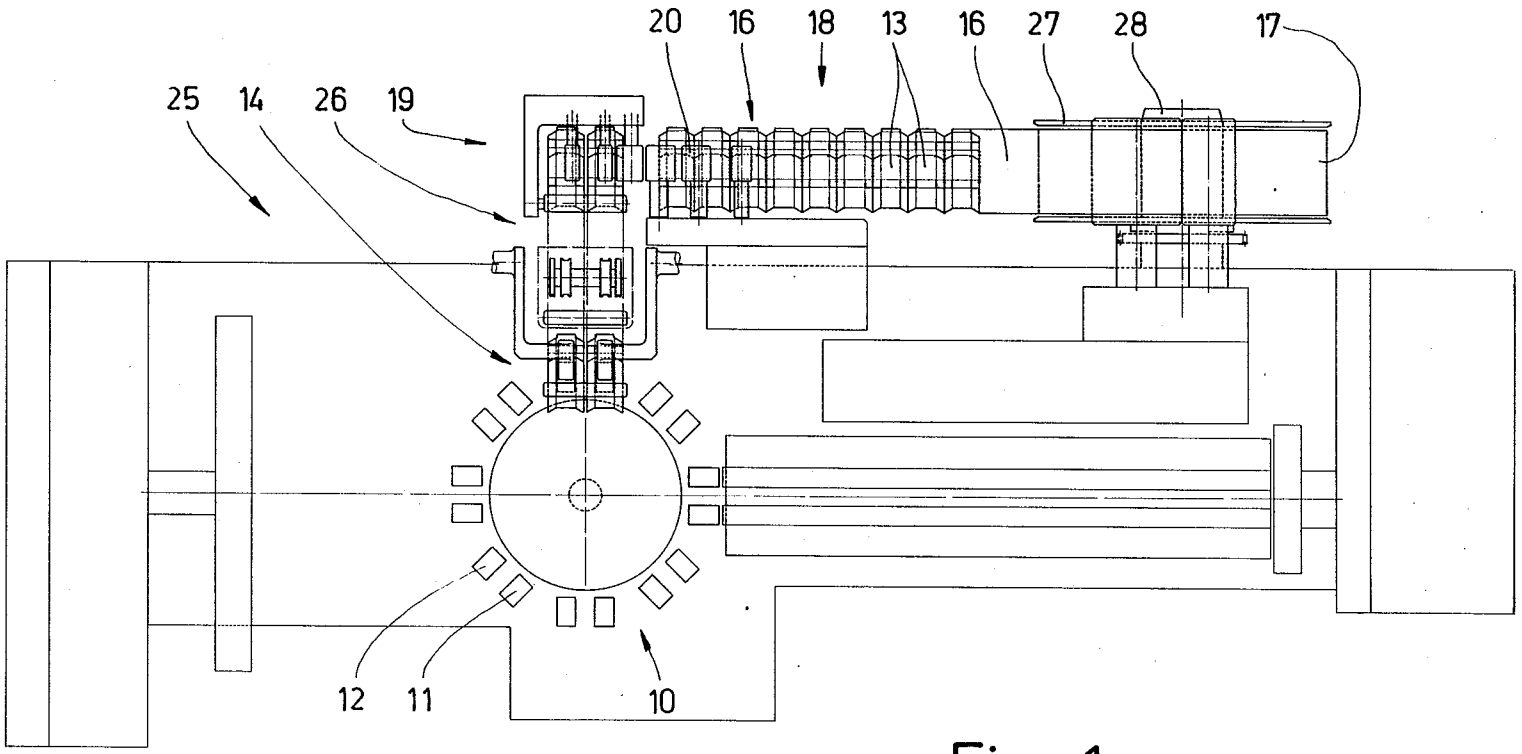

The invention relates to an apparatus for the production of (cigarette) packs, especially hinge-lid packs, from blanks which are severed from a continuous web of material and fed to a folding unit.

A cigarette-packaging machine of this type is the subject of DE-A-2,440,006. The blanks for producing such packs consist of thin cardboard. They are made outside the packaging machine and fed to the packaging machine in stacks. The packaging machine is equipped with a blank magazine, from which blanks for processing are extracted individually. The blanks are fed along a blank track to a folding turret rotating about a vertical axis and are folded and filled in the region of the latter.

The invention is concerned with the production of the blanks and the feeding of these to the folding turret. The invention starts from the fact that the blanks are produced in the region of the packaging machine by being severed from a continuous web of material. This is supplied to the packaging machine, itself, in the form of a reel. In particular, the production of the blanks is carried out in accordance with the features listed in German Patent Application P 37 16 897.5.

The object on which the invention is based is to organize the production of the blanks and their transport within the packaging machine, itself, so that the functioning of the packaging machine is not otherwise impaired, but so that the units for producing and transporting the blanks are easily accessible.

To achieve this object, in the apparatus according to the invention the web of material is guided along a conveying track in the rear region of the apparatus and essentially parallel to the longitudinal mid-plane of the apparatus, and the blanks, after being severed from the web of material, can be fed transversely relative to this to the folding unit along a blank track in the direction of the front of the apparatus.

The positioning of the members for producing and conveying the blanks at the rear of the packaging machine allows free access to this and to its members from the front. On the other hand, access to the blank unit is provided at the rear of the packaging machine. In particular, after a web of material has been used up, the reels can be exchanged easily here. Furthermore, the web of material and the blanks cover only short conveying distances.

According to a further proposal of the invention, a store for the web of material is formed in the region of the transport zone of the latter, especially as a result of the laying of a portion of the web of material in zig-zag form.

The formation of a store of web of material or of blanks by laying the web of material in the form of a concertina is especially advantageous when, according to German Patent Application P 37 16 897.5, the blanks are delimited from one another within the web of material by perforations, part cuts, etc. In the region of the transversely directed weakenings of material, the blanks are folded against one another to form a zig-zag-shaped structure of the web of material. The blanks thus lie closely against one another and so make it possible to obtain a high storage capacity in a confined space.

According to the invention, the zig-zag-shaped store of web of material is formed in a specially designed storage container, through which the web of material runs On the entry side of this, the web of material is folded to form the zig-zag-shaped structure, specifically because the web of material runs onto the already existing store. On the opposite side, the zig-zag-shaped structure is cancelled by pulling the web of material into the extended position. This takes place when the web of material comes out of the storage container.

Figure 2:
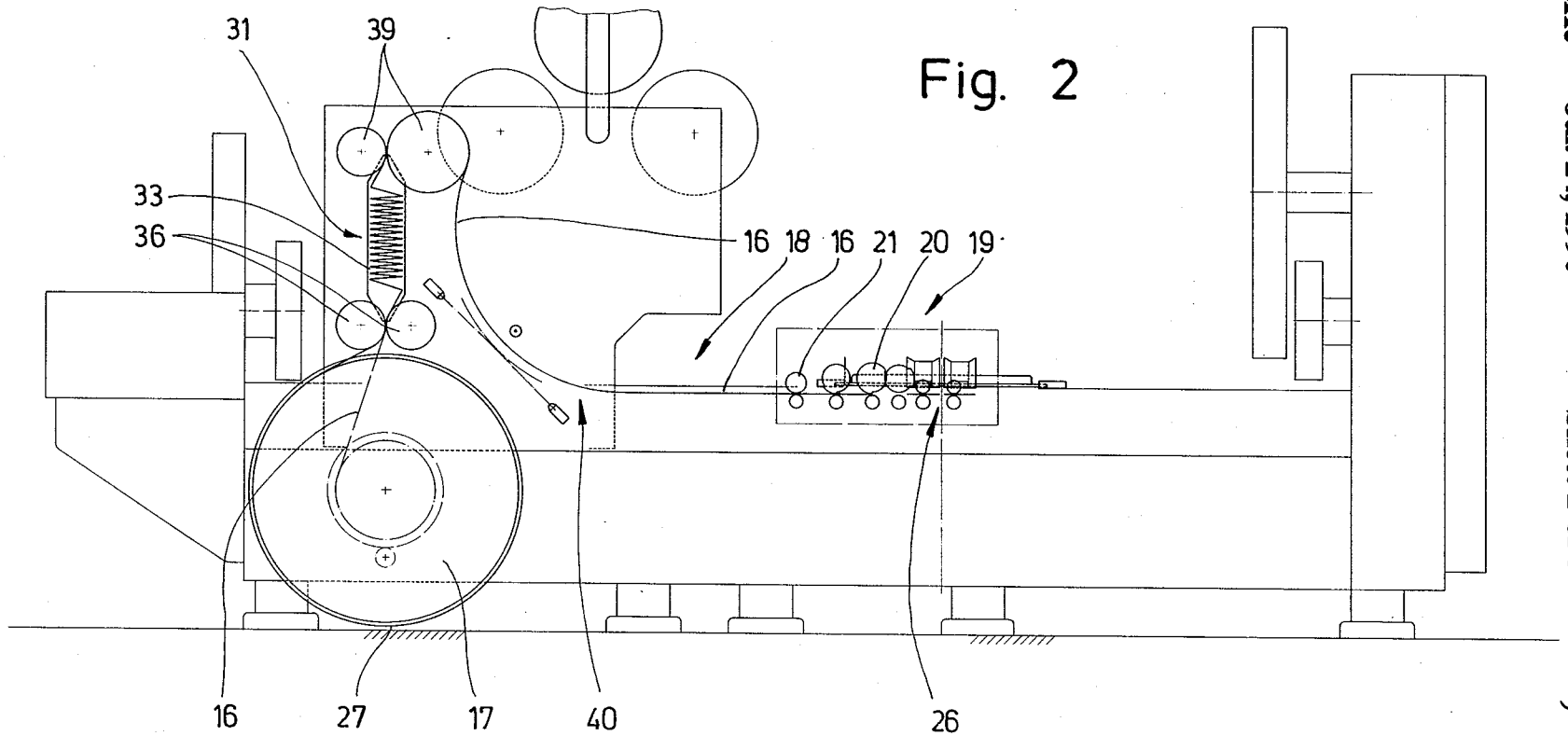
Figure 3:
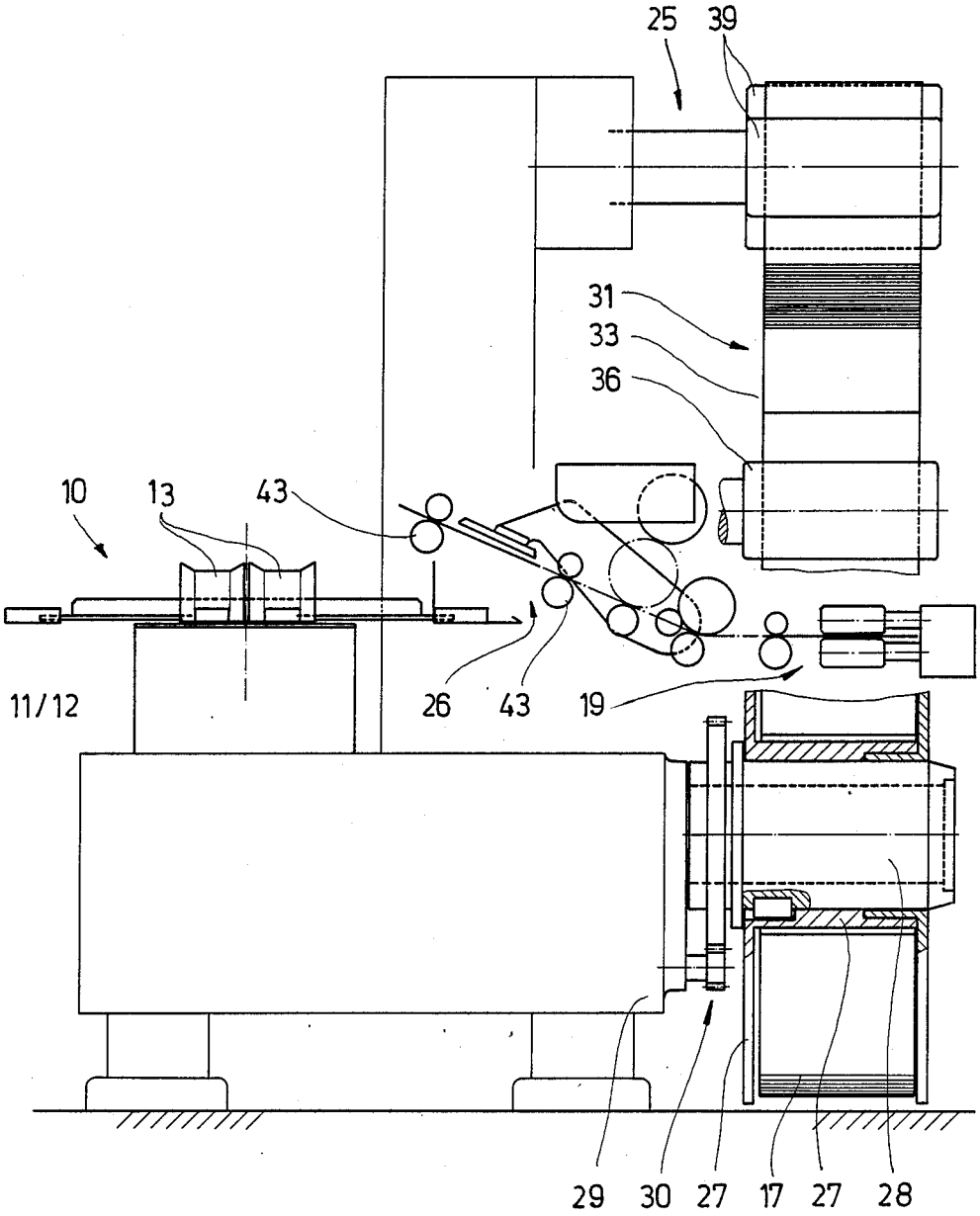
Figure 4:
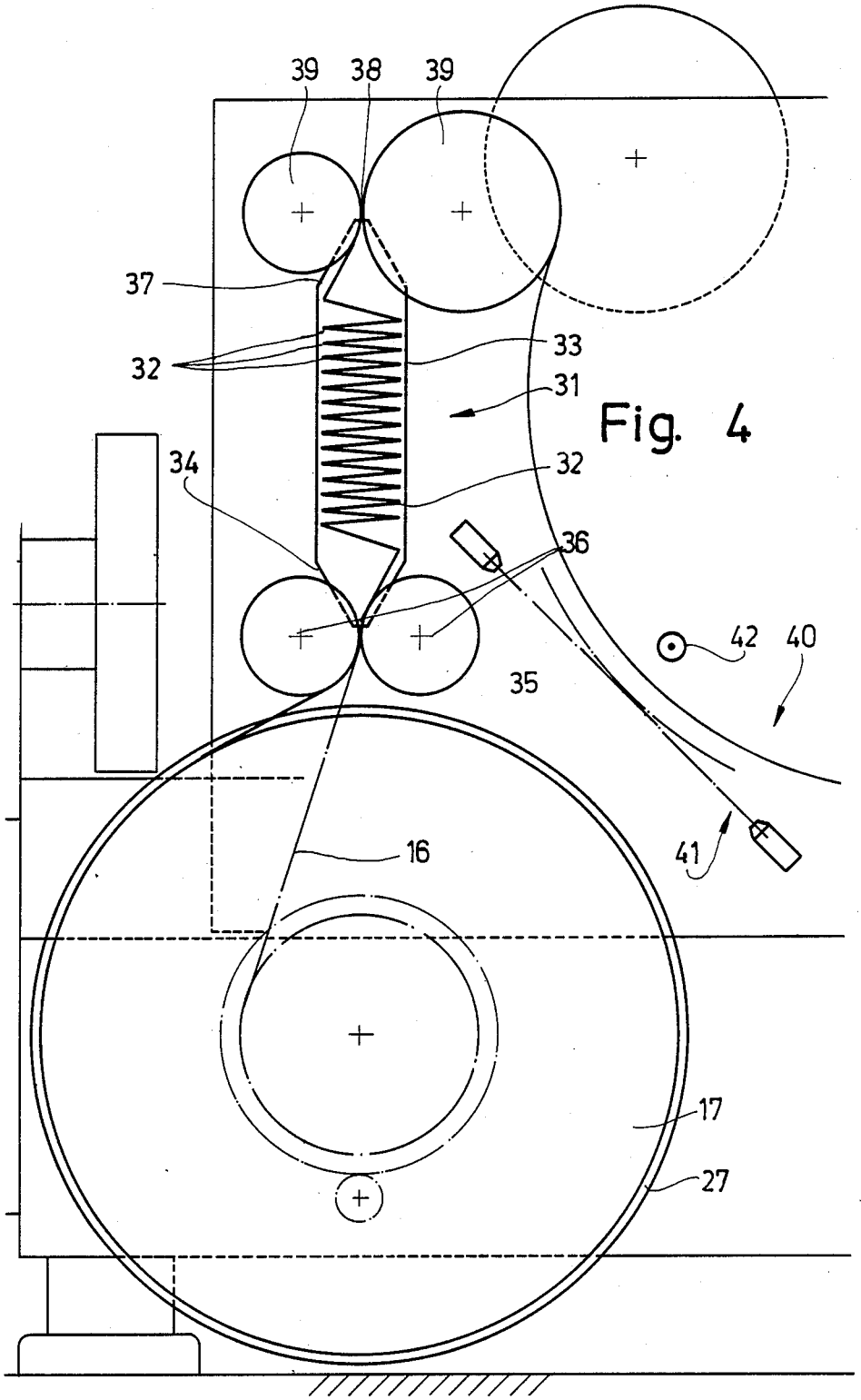
Figure 5:
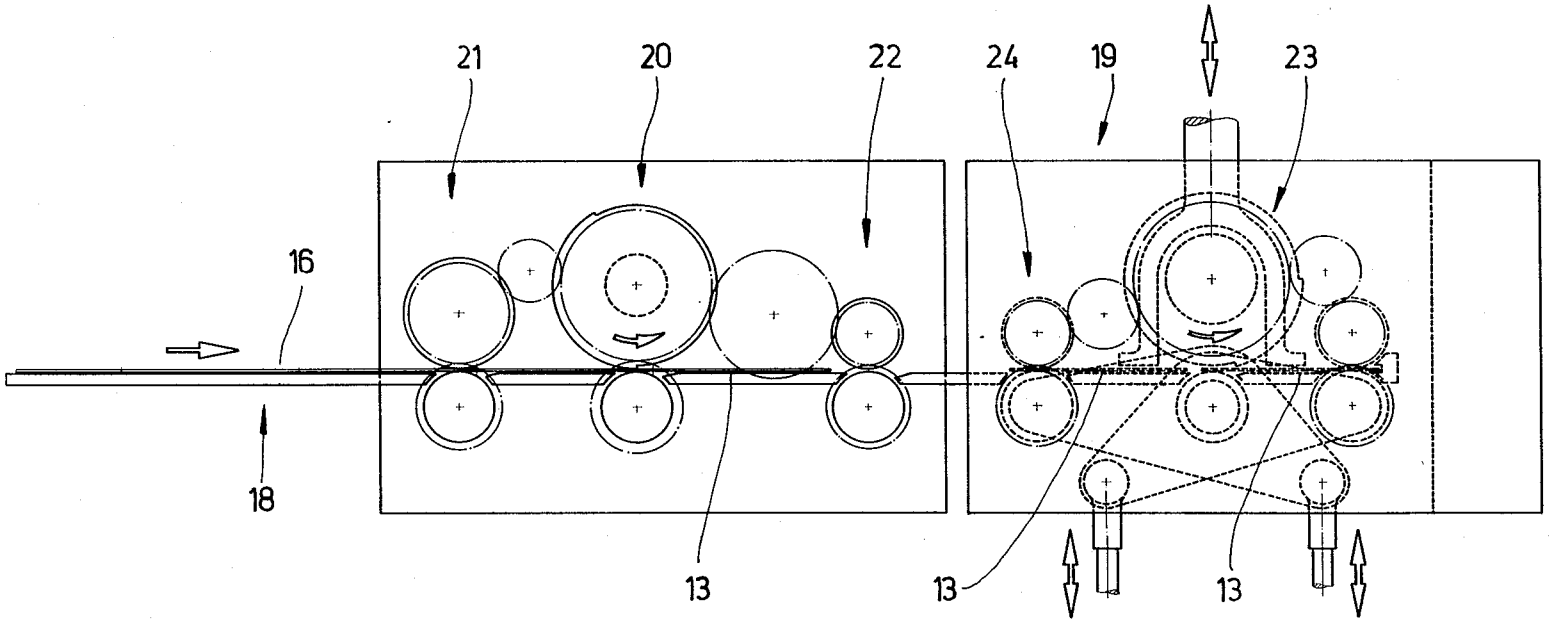

Furthermore, according to the invention, in the region of the conveying track for the web of material a web sag is formed which performs the function of making it easier to sever the blanks from the web of material in the region of a press station. Further features of the invention relate to the arrangement of units for the production and transport of the web of material and of the blanks. An exemplary embodiment of the invention is explained in detail below by means of the drawings. In these:

FIG. 1 shows a packaging machine in a diagrammatic plan view,

FIG. 2 shows a likewise diagrammatic side view of the packaging machine according to FIG. 1, FIG. 3 shows a transverse view or cross-section of the packaging machine according to FIGS. 1 and 2 on an enlarged scale, FIG. 4 shows a side view of a detail of the packaging machine with a store for the web of material on an enlarged scale, FIG. 5 shows a side view of a severing station for the production of blanks as a detail of the packaging machine. The exemplary embodiment of a packaging machine illustrated in the drawings is intended for the production of hinge-lid packs for cigarettes. In FIGS. 1 and 2, the packaging machine is shown diagrammatically in a plan view and a side view. The central packaging member is a folding turret 10 which has a number of pockets 11, 12 arranged along the circumference, each for receiving a pack. The folding turret is made plate-shaped and rotates about a vertical axis. In the example shown (FIG. 1), two respective parallel pockets 11, 12 are arranged next to one another for the simultaneous feeding and production of packs.

Blanks 13 are fed to the folding turret 10 or the pockets 11, 12. These are introduced (in pairs) from above into a pocket 11, 12 of the folding turret 10 in the region of a pushing-in station 14. For this purpose, in the pushing-in station 14 there is, above or next to the folding turret 10, a pressing-in ram 15 movable up and down, which presses individual blanks or two blanks simultaneously into pockets 11, 12 located underneath, the blanks being folded at the same time. To this end, the pushing-in station 14 can be designed essentially as described in DE-A-2,440,006.

The blanks 13 are produced in the region of the apparatus or the packaging machine, specifically by being severed from a web of material 16. This is supplied to the packaging machine as a large-volume reel !7. The web of material 16 is drawn off from the rotatably mounted reel 17 along a conveying track 18 and fed to a severing station 19. In the region of this, the blanks are severed from the web of material 16 individually or, as in the exemplary embodiment illustrated, in pairs. The blanks are then fed to the pushing-in station 14.

The web of material 16 and the blanks 13 can be of differing design. In the present exemplary embodiment the procedure for forming the web of material 16 and the blanks 13 is in conformity with German Patent Application P 37 16 897.5. This means that individual blanks 13 oriented transversely relative to the longitudinal direction of the web of material 16 are marked by prestampings. The continuity within the web of material 16 is predetermined by residual connections between the blanks 13. In the region of the severing station 19, the blanks 13 are severed from the web of material 16 by being torn off and thus become individual.

Details of the severing station 19 are shown on an enlarged scale in FIG. 5. This embodiment is designed to produce and process two blanks 13 simultaneously. For this purpose, two blanks 13 lying next to one another are first torn off as a unit from the web of material 16 specifically by a first pair of tearing rollers 20. These are preceded by a pair of feed rollers 21. The tearing rollers 20 are driven at a higher circumferential speed than the feed rollers 21. As a result, a tensile force acting in the longitudinal direction is generated within the web of material 16 and causes the two blanks 13 to be severed. The tensile force is exerted only temporarily as a result of an appropriate design of the tearing rollers 20.

The two blanks 13 severed from the web of material 16, but still connected to one another are delivered by conveying rollers 22 to a further pair of tearing rollers 23. These interact with preceding feed rollers 24. The two blanks 13 are severed as a result of the higher speed of the tearing rollers 23 in relation to the feed rollers 24. The two individual blanks are then fed to the folding turret 10.

The abovementioned units and arrangement for the web of material 16 and reel 17 and for producing the blanks 13 are arranged on a rear side 25 of the elongate packaging machine. The web of material 16 or the conveying track 18 for this and for the blanks 13 extends parallel to an (imaginary) longitudinal mid-plane of the packaging machine. At the end of the conveying track 18 is located the severing station 19. From here, the severed individual blanks 13 or two blanks 13 at a time are fed to the folding turret 10, lying next to one another on a blank track 26 directed transversely relative to the conveying track 18, that is to say adjoining the latter at right-angles. The path of movement for the blanks 13 in the region of the conveying track 18 on the one hand and of the blank track 26 on the other hand, is therefore made angular or L-shaped. As a result of the arrangement on the rear side 25, on the one hand it is possible to have unimpeded access to these members. On the other hand, the opposite front side (longitudinal side) of the packaging machine remains free of members for producing and conveying the blanks 13.

The reel 17 is arranged on a reel roll 27 which itself is mounted on a stationary supporting journal 28 pointing rearwards on the rear side 25 of the packaging machine. The supporting journal 28 (FIGS. 1 and 3) is driven in rotation by means of a motor 29 via a gear 30. The reel 17 together with the reel roll 27 can therefore be slipped freely onto the supporting journal 28 and removed from this from the rear side 25.

A web store 31 (FIGS. 2, 4 and 5) is arranged for the web of material 16, likewise on the rear side 25 of the packaging machine. In the present exemplary embodiment, the web store 31 is formed as a result of the laying of the web of material 16 in zig-zag form (a concertina-like arrangement of the latter). Kinks 32 are located respectively at the edges of the blanks 13 in the region of the residual connections with the adjacent blanks. This makes it easier to fold the web of material 16 in zig-zag form in the region of the web store 31 and return the web of material 16 to the plane position at the exit of the web store 31.

In the exemplary embodiment shown, the zig-zag shaped folding of the web of material 16 takes place in the region of an appropriately designed storage container 33. In the present case, this is arranged vertically and adjacent to the reel 17. The storage container 33 is of rectangular cross-section, so that the blanks 13 folded on one another can be accommodated in the storage container 33 with a clearance in the longitudinal and transverse directions.

On the entry side, the storage container 33 is designed with a funnel-shaped run-in piece 34. At the lower or entry end there is an entry slit 35 for the web of material 16. Directly in front of this is a pair of push rollers 36 which on the one hand take over the web of material 16 from the reel 17 and on the other hand push it into the storage container 33. Because the web of material 16 runs onto the store already formed, that is to say onto the folded stack of blanks 13, further folding takes place in the region of the weak points or residual connections.

On the opposite upper side, a funnel-shaped runout piece 37 is likewise attached to the storage container 33, specifically with an exit slit 38 of the dimensions of the web of material 16. Via draw rollers 39 adjacent to this, the web of material 16 is drawn continuously out of the storage container 33, specifically through the central exit slit 38 of the run-out piece 37. The zig-zag-shaped folding of the web of material 16 is thereby cancelled again automatically and the latter is brought into an extended postion. One of the draw rollers 39 is at the same time designed with a larger diameter as a deflecting roller for the web of material 16.

After the draw roller 39, the web of material 16 forms a sag 40. The size of this is monitored by two checking members arranged at a distance from one another, in particular by light barriers 41 and 42. Any detected variations of the sag 40 above or below a critical amount cause a variation of the conveying speed of the web of material 16, so that there is always a sag 40 in the region defined by the light barriers 41, 42. The sag 40 is necessary to guarantee a ten$ion-free mode of operation of the members in the region of the severing station 19.

In the present exemplary embodiment, the already mentioned blank track 26, transverse relative to the conveying track 18, consists of conveying rollers 43 and guide members bridging the interspaces, in particular lateral guide rails, etc. These are not shown in detail here for the sake of simplification. The blank track 26 is designed here to rise obliquely in the conveying direction, and in the end position the blank 13 likewise assumes an obliquely directed position above a pocket 11, 12 of the folding turret 10.

We claim:

1. In a longitudinally elongated apparatus for the production of hinge-lid cigarette packs from a moving continuous web of material, said apparatus having a vertical height and a longitudinally extending front side and a longitudinally extending rear side, severing means (19) for severing individual blanks (13) from the web of material (16), and means including a rotary folding turret (10) for receiving the severed blanks and folding the blanks in the formation of said hinge lid packs, the improvement comprising:

means for guiding the web of material (16) longitudinally along a longitudinal conveying track (18) which is located on the rear side (25) of the apparatus and which is essentially parallel to the longitudinal mid-plane of the apparatus;

said severing means (19) being located on said rear side (25) of said apparatus; and means for conveying the severed blanks along a plank track (26) transversely relative to the conveying track (18), in a direction from said rear side (25) towards said front side, to said folding turret (10).

2. Apparatus according to claim 1, further comprising at least one reel (17) for the web of material (16), said reel (17) being located on the rear side (25) and being mounted on a rearwardly extending supporting journal (25).

3. Apparatus according to claim 1, wherein said severing means (19) is located at an end of the longitudinal conveying track (18).

4. Apparatus according to claim 3, further comprising means for forming a sag (40) in the web of material (16) upstream of said severing means (19), and monitoring means (41 and 42) for monitoring the size of the sag (40).

5. Apparatus according to claim 3, wherein said folding turret (10) is rotatable around a vertical axis and wherein the blank track (26) rises from the severing means (19) and terminates above pockets (11, 12) in the folding turret (10).

6. Apparatus according to claim 1, wherein said blanks (13) are connected to one another via residual connections in said web of material (16), and further comprising storing means, also located on said rear side (25), for storing the web of material (16) in a zig-zag shape formed by folding of the web along the residual connections.

7. Apparatus according to claim 6, wherein said storing means comprises a storage container (33) which has an entry side and an exit side, and in which the web of material (16) is folded in a zig-zag form on the entry side and straightened on the exit side.

8. Apparatus according to claim 7, wherein said storage container (33) comprises: a run-in piece (34) which widens in a funnel-shaped manner, and which has an entry slit (35); and a run-out piece (37) which narrows in a funnel-shaped manner and which has an exit slit (38); each of said entry and exit slits being dimensioned to pass the web of material (16).

9. Apparatus according to claim 7, further comprising: a pair of push rollers (36) located immediately upstream of said entry side of the storage container (33) in the conveying direction of the web; and a pair of draw rollers (39) disposed on said exit side of the storage container (33).

* * * * *